US006279774B1

(12) United States Patent
Clute et al.

(10) Patent No.: US 6,279,774 B1
(45) **Date of Patent: *Aug. 28, 2001**

(54) COVER LOCKING MECHANISM

(75) Inventors: Charles P. Clute; Darrell Davis, both of Indianapolis, IN (US)

(73) Assignee: Southcorp Packaging USA, Atlanta, GA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/099,980

(22) Filed: Jun. 19, 1998

Related U.S. Application Data

(63) Continuation-in-part of application No. 08/705,813, filed on Aug. 30, 1996, now Pat. No. 5,873,484.

(51) Int. Cl.[7] ..... B65D 41/48

(52) U.S. Cl. ..... 220/792; 220/276; 220/781; 220/780

(58) Field of Search ..... 220/266, 270, 220/276, 780, 781, 782, 792, 793, 796, 805, 305; 206/508, 509, 511, 503

(56) References Cited

U.S. PATENT DOCUMENTS

| | | | | |
|---|---|---|---|---|
| 3,170,588 | * | 2/1965 | Lyon, Jr. | 220/780 |
| 3,352,448 | * | 11/1967 | Livingstone | 220/782 |
| 3,510,023 | | 5/1970 | Ullman et al. . | |
| 3,642,167 | * | 2/1972 | Kinney | 220/780 |
| 3,989,142 | * | 11/1976 | Gwilliam, Jr. et al. | 206/508 |
| 4,256,240 | * | 3/1981 | Woinarski | 220/782 |
| 4,305,517 | | 12/1981 | Dennis . | |
| 4,420,093 | * | 12/1983 | Von Holdt | 220/782 X |
| 4,437,593 | | 3/1984 | Bullock, III . | |
| 4,457,447 | * | 7/1984 | Kirkis | 220/780 |
| 4,566,601 | | 1/1986 | Kuenzig . | |
| 4,589,561 | | 5/1986 | Crisci . | |
| 4,593,830 | | 6/1986 | Bullock . | |
| 4,625,876 | | 12/1986 | Bullock, III . | |
| 4,632,265 | | 12/1986 | Cochrane . | |
| 4,658,977 | | 4/1987 | Crisci . | |
| 4,660,735 | | 4/1987 | Peschardt et al. . | |
| 4,790,448 | | 12/1988 | Ostrum et al. . | |
| 4,798,301 | | 1/1989 | Bullock et al. . | |
| 4,815,620 | | 3/1989 | Bullock, III . | |
| 4,930,656 | | 6/1990 | Blanchette . | |
| 4,984,701 | | 1/1991 | Margaria . | |
| 5,046,632 | | 9/1991 | Bordner . | |
| 5,092,478 | * | 3/1992 | La Pierre | 220/276 X |
| 5,103,993 | * | 4/1992 | Bingisser | 220/782 |
| 5,292,024 | * | 3/1994 | Koefelda et al. | 220/782 X |
| 5,328,047 | | 7/1994 | Smith . | |
| 5,373,955 | | 12/1994 | Marino . | |
| 5,377,861 | * | 1/1995 | Landis | 220/781 X |
| 5,460,287 | | 10/1995 | Cragile et al. . | |
| 5,540,349 | * | 7/1996 | Philips | 220/780 |

FOREIGN PATENT DOCUMENTS

| | | | | |
|---|---|---|---|---|
| 4422534 | * | 8/1995 | (DE) | 220/780 |
| 295 15 093 U 1 | | 1/1996 | (DE) . | |
| 613830 | * | 9/1994 | (EP) | 220/266 |

* cited by examiner

*Primary Examiner*—Nathan J. Newhouse
(74) *Attorney, Agent, or Firm*—Schnader Harrison Segal & Lewis LLP

(57) ABSTRACT

A container assembly is provided including a cover and a container. The cover and container components are adapted to resist deformation resulting otherwise from forces encountered during handling and storage. Accordingly, the resulting container assembly can withstand side impact, stacking and internal pressure.

11 Claims, 10 Drawing Sheets

COVER LOCKING MECHANISM

This is a continuation-in-part of the application Ser. No. 08/705,813 filed Aug. 30, 1996, now U.S. Pat. No. 5,873, 484, granted Feb. 23, 1999.

BACKGROUND OF THE INVENTION

This invention relates to a cover that can be securely locked to a container to prevent cover removal during handling and storage.

FIELD OF THE INVENTION

There is an ongoing demand for container assemblies capable of providing a secure lock between the cover and container. It is particularly desirable for container assemblies to withstand the forces caused by handling during shipment and storage. Containers are known to be inadvertently dropped, tipped, overstacked, and otherwise mishandled. It is important for container assemblies to maintain their integrity despite such mishandling.

Container assembly integrity is particularly important for plastic containers of relatively large size (e.g., 3.5 gallons or more) that are used to contain "Regulated Materials" (as defined by the United States Department of Transportation) such as toxic, corrosive, flammable and poisonous materials in liquid or non-liquid form. The United States Department of Transportation sets minimum performance requirements based on container contents. Similar requirements in the United States Code of Federal Regulations govern drop-tests, burst-strength and other standards to assure that containers will not burst or spill during shipment or during rough handling at filling or storage facilities. Although it is particularly important that containers filled with Regulated Materials adhere to governmental regulations, container integrity is of course desirable for many other uses as well.

OBJECTS OF THE INVENTION

It is an object of the invention to provide an improved locking mechanism for a container assembly.

It is another object of the invention to provide a cover that can be securely locked to a container to prevent removal of the cover from the container during handling and storage.

It is yet another object of the invention to provide a container assembly that is stackable.

Other objects will be apparent to those of skill in this art in view of the following descriptions.

SUMMARY OF THE INVENTION

According to one preferred aspect of this invention, the container assembly's cover includes an outer skirt extending downwardly adjacent to its perimeter and the outer skirt defines an inwardly extending rib. The container body has an upper wall portion with a flange extending outwardly therefrom and positioned for engagement with the cover's rib. The outer diameter of the container's flange is larger than the inner diameter of the cover's outer skirt to cause interference between the flange and skirt that is preferably greater than about 0.2% as measured on the diameter. The interference is most preferably in a range from about 0.8% to about 1.5%.

According to another preferred aspect of this invention, the cover also includes an inner skirt extending downwardly from the cover's body and spaced radially inwardly from the outer skirt. A perimeter portion of the cover extends between the inner and outer skirts. A lock is formed by engaging the cover's rib with the container's flange upon insertion of the wall's upper portion into the radial space between the inner and outer cover skirts. The radial space is narrower than the upper portion of the container's wall and the perimeter portion of the cover has a reduced thickness and is sufficiently deformable for insertion of the wall's upper portion into the radial space for engagement.

Another preferred feature of the invention provides a plurality of supports extending between the perimeter portion of the cover in one plane and a body portion of the cover in another plane. The supports include a surface extending inwardly from the perimeter portion and an axially-extending surface that connects with the cover's body portion. The supports reduce movement of the cover's inner skirt with respect to the cover's body portion that can eliminate the need for support ribs that otherwise extend from the inner skirt toward the cover's body portion.

Yet another preferred aspect of the invention is provided to protect a container assembly against the forces that can be encountered during handling and storage. In this aspect, the cover's skirt defines an upper rib and a spaced lower rib and the container's wall defines an upper flange and a spaced lower flange. The cover's lower rib is engageable with the container's lower flange, and the cover's upper rib is engageable with the container's upper flange upon insertion of the container's upper wall portion into the radial space between the inner and outer cover skirts. An intermediate flange also extends outwardly from the container's wall at a position between the upper and lower flanges. Upon assembly, the intermediate flange resists radially inward deflection of the portion of the outer skirt between the upper and lower ribs, thereby resisting leakage and unintentional disengagement of the cover from the container.

A stackable container is also provided. The cover preferably includes a supporting surface that extends between the cover's perimeter and body portions wherein the supporting surface and the body portion together define a cover recess. The container includes a bottom portion adapted to rest on top of the body portion, and at least partially within the recess, of an underlying cover when the container is stacked on top of an underlying cover. A perimeter surface of the container's bottom portion and the supporting surface of the underlying cover are both sized to enable contact therebetween under load. The bottom portion and supporting surface cooperate with one another to resist excessive deflection of the underlying cover.

DETAILED DESCRIPTION OF THE INVENTION

Figure 1:
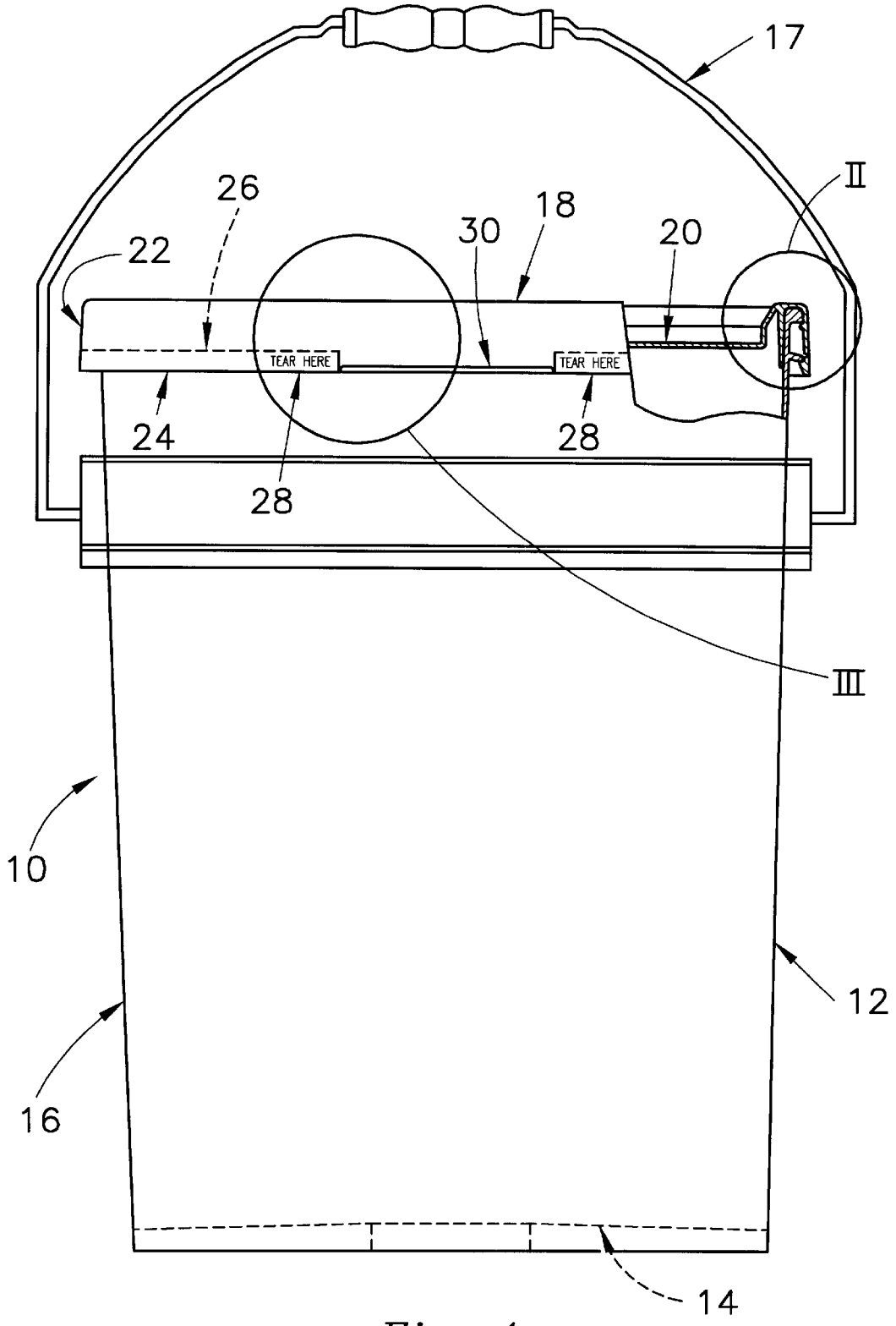
FIG. 1 is a side view of a container assembly embodying features of this invention.

The following description is intended to refer to the specific embodiments of this invention illustrated in the drawings. The description is not intended to define or limit the scope of the invention, which is defined separately in the claims that follow.

Referring to FIG. 1, the numeral "10" generally designates an embodiment of a container assembly according to this invention. Container assembly 10 includes a container 12, a handle 17 attached to container 12 and a cover 18 adapted for locking engagement to container 12. Container 12 and cover 18 are preferably formed from a suitable plastic by means of a molding process. Container 12 and cover 18 are most preferably formed from high-density polyethylene (HDPE), but are optionally formed from other suitable plastics such as low-density polyethylene (LDPE), polyethylene (PE), polypropylene (PP) and others. Such materials are preferably injection-molded to form container 12 and cover 18, utilizing known molding technologies.

Container 12 includes a bottom 14 and a wall 16 integrally formed with bottom 14 and extending upwardly from bottom 14. Container 12 is preferably cylindrical, but is optionally provided with any selected shape and in any selected size. Most preferably, container 12 is a give-gallon cylindrical pail. Also, container 12 is most preferably provided with a so-called "satellite ring" to enhance hoop strength. Further details of container 12 are described later with reference to FIG. 2.

Figure 2:
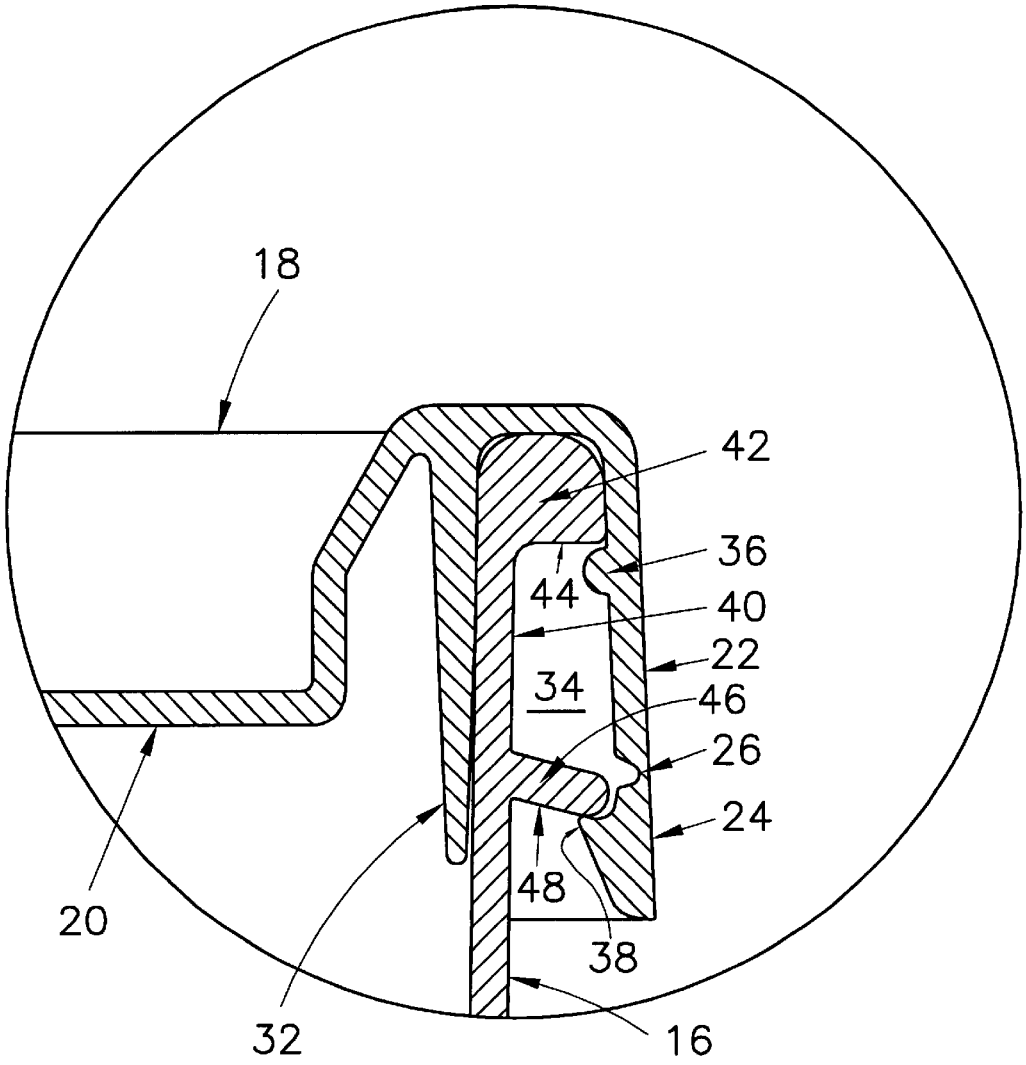
FIG. 2 is a cross-sectional side view of a detail of the container assembly embodiment shown in FIG. 1, as indicated in FIG. 1.

Cover 18 includes a cover body 20 shaped to extend across an opening at the top of container 12. At an outer perimeter of cover body 20 is formed a downwardly extending cover skirt 22. Formed integrally with cover skirt 22 is a tear strip 24 that extends around the majority of the circumference of cover skirt 22, but not around the entire circumference for reasons that will become clear later. Tear strip 24 is defined along its immediate upper edge by a tear line 26 that is preferably formed on an inside surface of cover skirt 22. Tear line 26 is preferably a continuous line of reduced material thickness (as shown in FIG. 2). Tear line 26 is optionally a line of perforations. In any form, tear line 26 permits removal of tear strip 24 by tearing cover skirt 22 along tear line 26. Tear strip 24 is preferably of constant height along its circumferential length. Also, tear strip 24 is preferably smooth (i.e., not serrated) to provide for easy handling. Most preferably, the only connection between tear strip 24 and the remainder of cover skirt 22 is along tear line 26 so that no material additional to that along tear line 26 connects tear strip 24 to cover 18, thereby facilitating easy removal of tear strip 24 by an end user of container assembly 10.

Two end portions 28 of tear strip 24 are preferably provided to assist an end user with removal of tear strip 24. End portions 28 of tear strip 24 are preferably reduced in thickness relative to the remainder of tear strip 24 to make it easier for an end user to initiate the tearing process that removes tear strip 24 from cover skirt 22. Cover skirt 22 also includes a grip portion 30 extending to the bottom edge of cover skirt 22. Grip portion 30 occupies the circumferential portion of the bottom of cover skirt 22 that is left after removal of tear strip 24. Further details of grip portion 30 are described later with reference to FIGS. 3 and 4.

Referring now to FIG. 2, a cross-sectional view of a detail designated in FIG. 1 is shown. In the preferred embodiment of cover 18, a cover flange 32 extends downwardly from cover body 20 and radially-extending ribs are preferably provided for support between the undersurface of cover body 20 and the inner surface of cover flange 32. An annular recess 34 is formed by the outer surface of cover flange 32, the lower surface of cover body 20, and the inner surface of cover skirt 22. Integrally formed on cover skirt 22 is an upper rib 36 which preferably extends continuously around the entire circumference of cover skirt 22. Upper rib 36 extends radially inwardly from the inside surface of cover skirt 22 and extends into annular recess 34.

FIG. 2 illustrates details of tear strip 24 formed at the bottom edge of cover skirt 22 as well as tear line 26 defined in the inner surface of cover skirt 22, which provides a border between tear strip 24 and the remainder of cover skirt 22. Formed on the inside surface of tear strip 24 is a lower rib 38 which preferably extends continuously along the length of tear strip 24. Lower rib 38 extends radially inwardly into annular recess 34. As described earlier, end portions 28 of tear strip 24 (shown in FIG. 1) are preferably thinner than the remainder of tear strip 24. Accordingly, lower rib 38 preferably extends along the entire length of tear strip 24, except that lower rib 38 is not formed on the inner surface of end portions 28 of tear strip 24.

At the upper-most end of container 12 is formed an upper portion 40 of wall 16. Upper portion 40 includes at its upper edge an upper flange 42 which is positioned adjacent to the opening in container 12. Upper flange 42 extends radially outwardly from wall 16 to form a so-called "pail curl." Upper flange 42 most preferably has a rounded top edge to provide a surface for sealing engagement against the lower surface of cover body 20. A gasket (not shown) is optionally placed between upper flange 42 and cover body 20 to supplement the seal, if desired. Upper flange 42 has a lower surface 44, the significance of which is made clear later.

Upper portion 40 of wall 16 also includes a lower flange 46 that extends outwardly from wall 16. As shown in FIG. 2, lower flange 46 preferably extends outwardly and downwardly. Most preferably, lower flange 46 forms a slight angle to the horizontal. For example, an angle of about 25 degrees is advantageous. Other angles, or no angle at all, are also contemplated. Lower flange 46 is axially-spaced along wall 16 from upper flange 42. Lower flange 46 has a lower surface 48, the significance of which is described later.

When cover 18 is installed onto container 12 to form container assembly 10, the locking mechanism of this invention forms a seal to prevent leakage of contents from the container assembly, a primary lock to prevent cover removal during handling, and a secondary lock for cover removal and replacement by an end user. Details of each of these features are now described with reference to FIG. 2.

Application of cover 18 to container 12 creates a seal between cover 18 and container 12. Preferably, the outer surface of cover flange 32 sealingly contacts the inner surface of container wall 16. Also, the upper surface of upper flange 42 sealingly contacts the lower surface of cover body 20 at a location between cover skirt 22 and cover flange 32. Such points of contact provide a seal to prevent leakage or spillage of material from within container assembly 10.

A primary lock is formed between cover 18 and container 12 by engagement between lower rib 38 on tear strip 24 and lower surface 48 of lower flange 46 on container wall 16. This engagement is referred to as a "primary" lock because cover 18 cannot be removed from container 12 without first disengaging the lock formed between lower rib 38 and lower flange 46. Also, lower rib 38 of the primary lock preferably extends farther into annular recess 34 than upper rib 36 of the secondary lock, thereby providing a stronger lock because of increased interference between the cover lower rib 38 and the container lower flange 46,48 in the primary lock as compared to the secondary lock.

The secondary lock is formed between cover 18 and container 12 by engagement between upper rib 36 on cover skirt 22 and lower surface 44 of upper flange 42. This lock is considered a "secondary" lock because it cannot be removed until after the primary lock described above is disengaged. Also, engagement between upper rib 36 and upper flange 42 preferably creates a removable and replaceable lock of moderate strength, sometimes referred to in the industry as a "burp-type" lock or seal.

Figure 3:
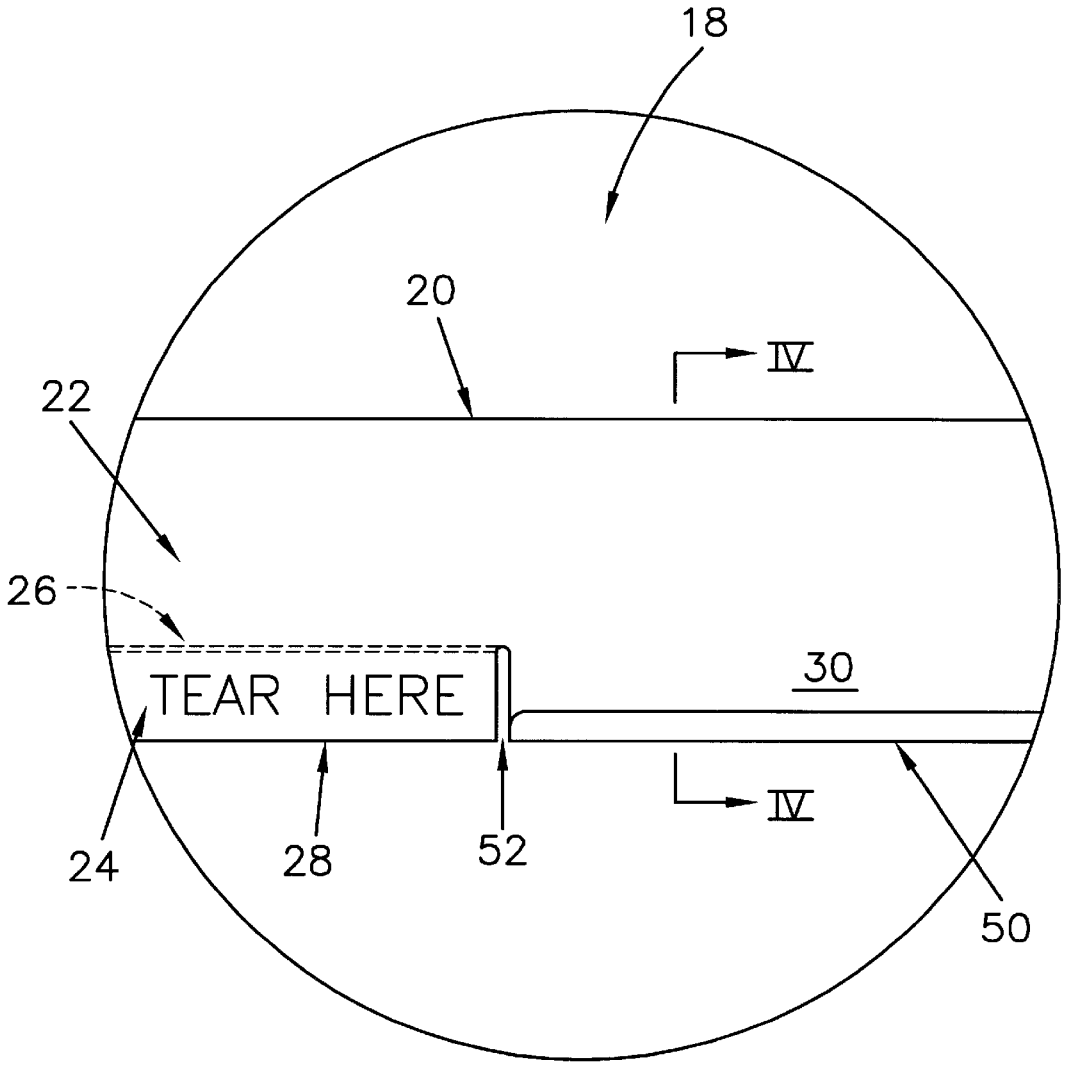
FIG. 3 is a side view of a detail of the container assembly embodiment shown in FIG. 1, as indicated in FIG. 1.
Figure 4:
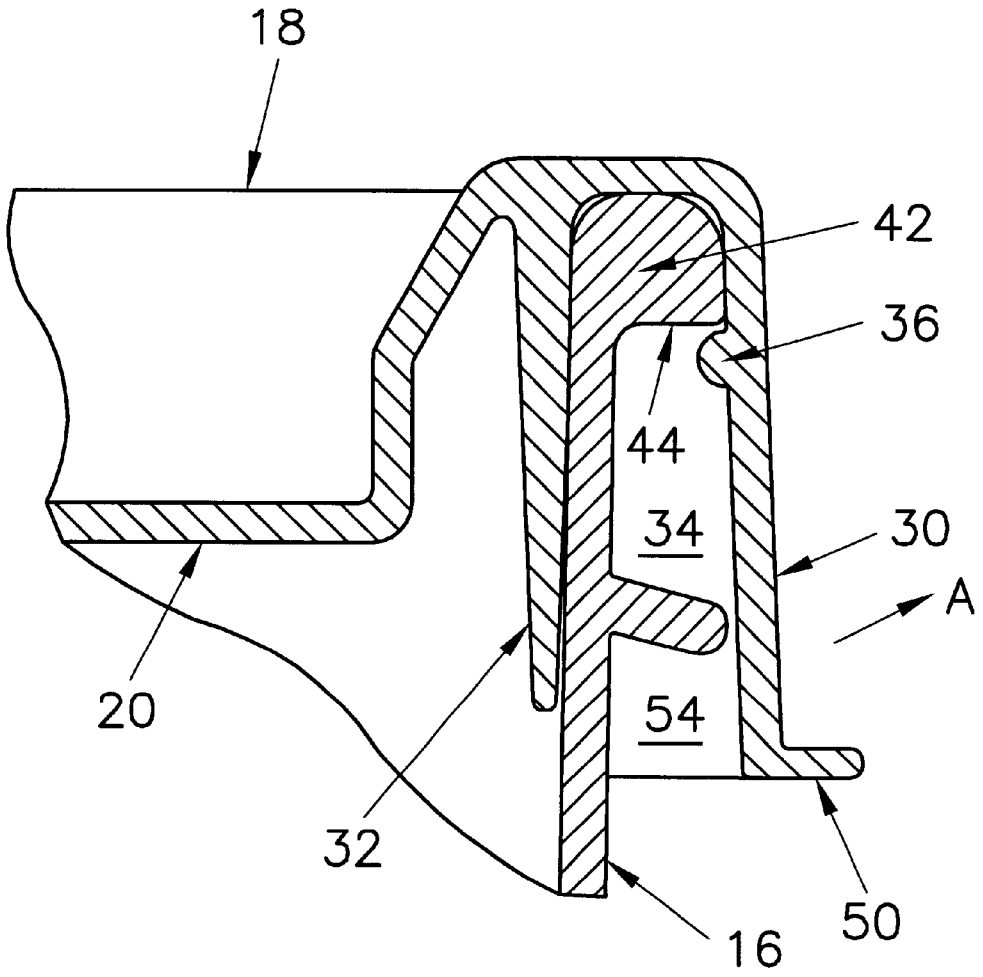
FIG. 4 is a cross-sectional side view of a detail of the container assembly embodiment shown in FIG. 1, as indicated in FIG. 3.

Referring to FIGS. 3 and 4, further details of cover skirt 22 are illustrated. Referring specifically to FIG. 3, tear strip 24, tear line 26 and one end portion 28 of tear strip 24 are illustrated. Tear line 26 is shown in phantom because it is preferably formed on the inside surface of cover skirt 22. The lettering "TEAR HERE", or a similar message, is preferably formed on end portions 28 of tear strip 24 to indicate to an end user the preferred locations from which the tearing operation is initiated.

Details of grip portion 30 are also illustrated in FIGS. 3 and 4. Grip portion 30 has at its lower-most edge a grip flange 50 that extends radially outwardly from cover skirt 22. Grip flange 50 provides a preferred surface against which the fingers of an end user can grasp cover 18 for cover removal, as is described later. A gap 52 is preferably provided between each side of grip portion 30 and end portions 28 of tear strip 24. Gaps 52 make it easier for an end user to begin the tearing process because the only material holding tear strip 24 to cover skirt 22 is along the frangible tear line 26. Removal of tear strip 24 merely requires a horizontal tear between tear strip 24 and cover skirt 22—no vertical tearing is required.

Referring specifically to FIG. 4, a cross-sectional view is provided at grip portion 30. The inside surface of grip portion 30 and the outside surface of wall 16 together define a passage 54 into which the fingertips of an end user are preferably placed to facilitate cover removal. Also, at least a portion of grip portion 30 is movable with respect to the remainder of cover assembly 10 in the outward and upward direction generally designated "A" in FIG. 4. Although upper rib 36 preferably continues through the circumferential portion of cover skirt 22 occupied by grip portion 30, FIG. 4 illustrates that lower rib 38 is preferably not formed on grip portion 30.

It is contemplated that more than one grip portion and more than one tear strip (one between each of multiple grip portions, for example) are optionally formed on the cover skirt.

Operation of container assembly 10 will now be described with general reference to FIGS. 1–4. Materials for shipment or storage are placed within the interior of container 12 in any known manner. Cover 18 is then applied to container 12 with a downward force until the cover locking mechanism is fully engaged. Preferably, cover 18 is forced downwardly onto container 12 until upper portion 40 of container 12 is inserted within annular recess 34 defined by cover 18. The upper surface of upper flange 42 then contacts the undersurface of cover body 20 and the inside surface of wall 16 contacts the outside surface of cover flange 32, thereby forming a leak-tight seal between cover 18 and container 12. Also, an upper surface of lower rib 38 engages lower surface 48 of lower flange 46, thereby engaging the primary lock. At substantially the same time, an upper surface of upper rib 36 engages lower surface 44 of upper flange 42, thereby engaging the secondary lock.

In this closed condition, container assembly 10 can be shipped, stored or otherwise handled until it is received by an end user. The combined effect of the primary lock, secondary lock and the leak-tight seal is to prevent spillage of contents from the container assembly and inadvertent cover removal.

In order to remove cover 18 from container 12, an end user first removes the primary lock. This is performed rather easily by the end user, without the use of any tools, by using his or her fingers to grasp tear strip 24 at one or both of end portions 28 and tearing cover skirt 22 along tear line 26 until tear strip 24 is completely separated from the remainder of cover skirt 22 (optionally, a portion of tear strip 24 remains attached). By this action, the primary lock is entirely disengaged because lower rib 38 is removed from cover 18 and from contact with lower surface 48 of lower flange 46. After removal of tear strip 24 and disengagement of the primary lock, the secondary lock remains in place to hold cover 18 on container 12.

In order to disengage the secondary lock and remove cover 18 from container 12, the end user places his or her fingertips within passage 54 and engages grip flange 50 of grip portion 30. A force is then applied by the user to move grip portion 30 in direction A (shown in FIG. 4). This action causes upper rib 36 to disengage from lower surface 44 of upper flange 42, beginning at the point directly above grip portion 30 of cover skirt 22. Continued movement of grip portion 30 causes complete disengagement of the secondary lock, until upper rib 36 passes to a position above upper flange 42, thereby permitting removal of cover 18 from container 12.

Once cover 18 is removed from container 12, the end user has access to the container interior. If desired, the end user can re-attach cover 18 to container 12 to protect and store any remaining container contents. To do so, the end user simply re-engages the secondary lock by forcing cover 18 down onto container 12 until upper rib 36 on cover skirt 22 engages lower surface 44 of upper flange 42. Once re-engaged, the secondary lock provides a moderate seal between cover 18 and container 12. Such a seal is sufficient for at least short-term material storage. At the end of use, container assembly 10 is preferably recycled.

Additional preferred aspects of this invention will now be described with reference to FIGS. 5–10.

Figure 5:
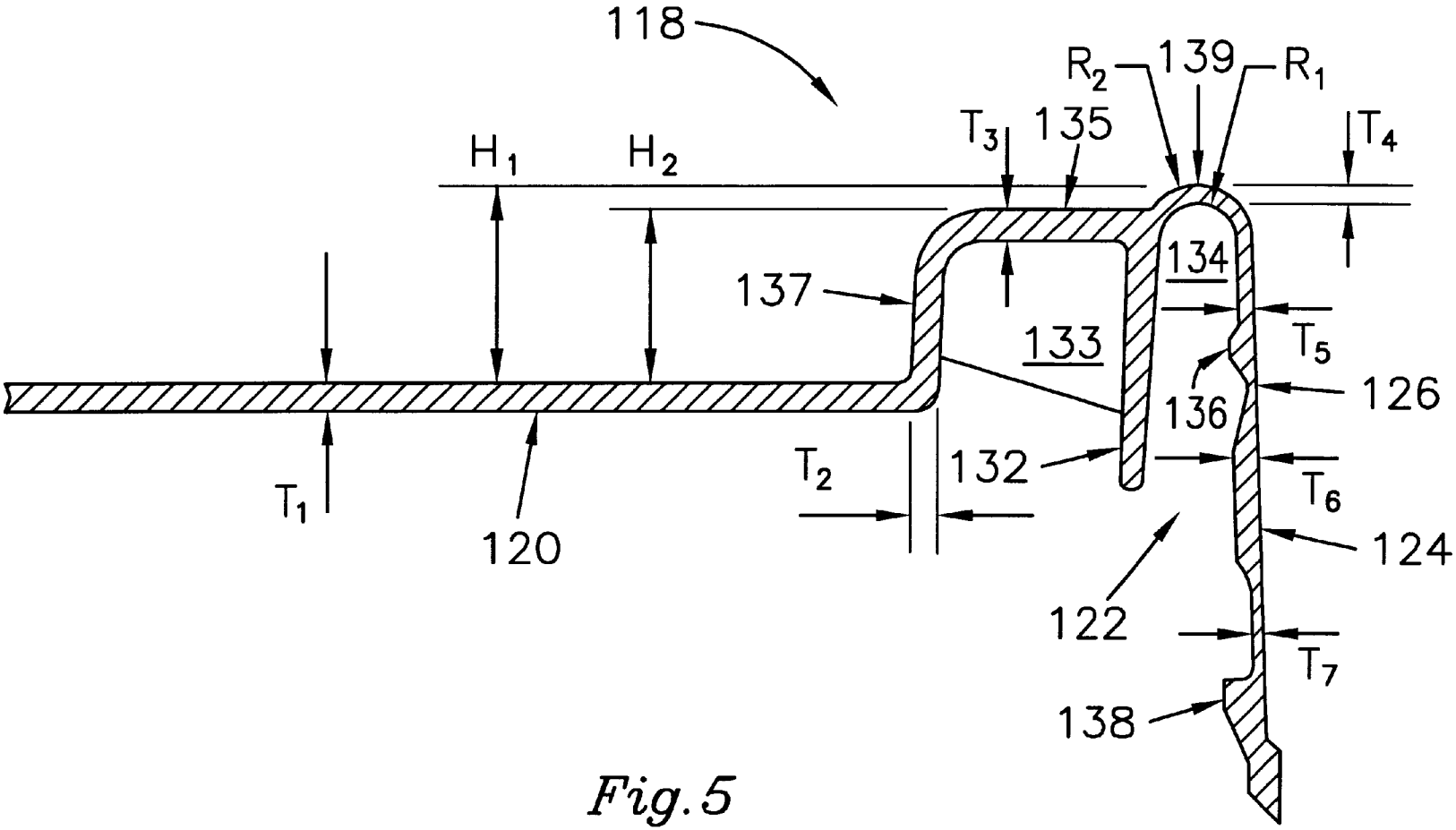
FIG. 5 is a cross-sectional side view of a detail of an embodiment of a cover according to this invention.
Figure 6:
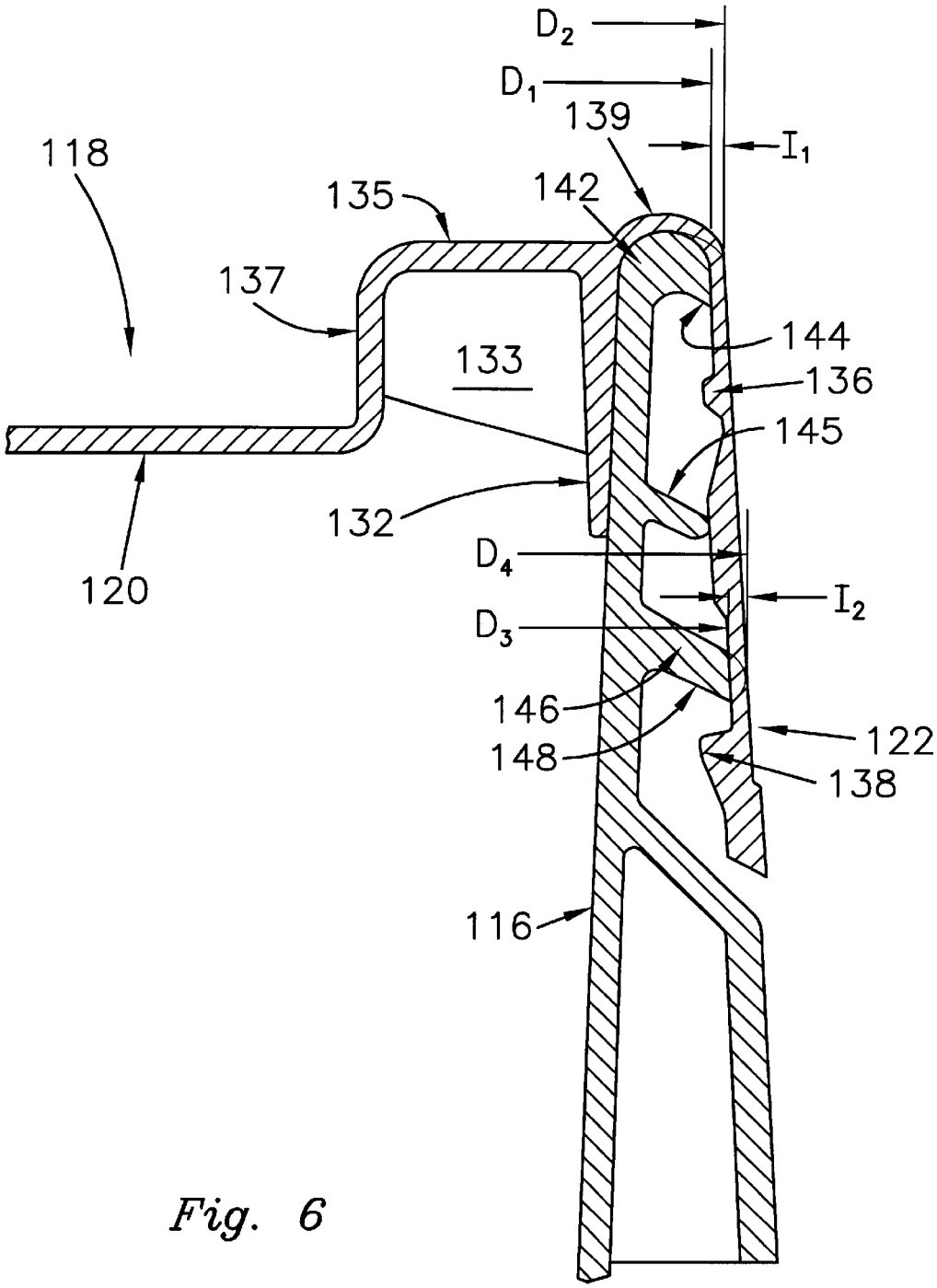
FIG. 6 is a cross-sectional side view of the cover shown in FIG. 5 superimposed on a cross-sectional side view of an embodiment of a container according to this invention.

Referring first to FIGS. 5 and 6, another embodiment of a cover according to this invention is designated by the numeral "118". It is similar to cover 18 shown in FIGS. 1–4 except that it includes several preferred features that can be incorporated into the cover to improve the integrity of the engagement between the cover 118 and container wall 116. Cover 118 includes a body portion 120 and a circumferential outer skirt 122 that extends downwardly adjacent to a perimeter portion 139. Cover 118 also includes an inner skirt 132 that preferably extends circumferentially as well as a plurality of vertical reinforcement ribs 133 that extend radially from inner skirt 132 toward body portion 120 for connection with a radially-extending surface 135 and an axially-extending surface 137. It is the surfaces 135 and 137 that together connect the perimeter portion 139 to body portion 120. Outer skirt 122 and inner skirt 132 together define a radial space 134 into which an upper portion of wall 116 can be inserted as shown in FIG. 6.

Outer skirt 122 includes a tear strip 124 that is defined by a tear line 126. Outer skirt 122 also includes an upper rib 136 and a lower rib 138. As illustrated in FIG. 6, upper rib 136 is positioned to engage a bottom surface 144 of an upper flange 142 provided on wall 116. Lower rib 138 is positioned to engage a bottom surface 148 of a lower flange 146, also formed on wall 116. An outer surface of wall 116 also defines an intermediate flange 145, the purpose of which will be made clear later.

Referring specifically to FIG. 6, portions of cover 118 are shown as overlapping with portions of wall 116 in order to illustrate and emphasize a preferred interference between the components. Specifically, there is a preferred interference between the outer edge of upper flange 142 of the container and the upper portion of the inner surface of outer skirt 122. Upper flange 142 has an outer diameter $D_2$ and the uppermost portion of outer skirt 122, between perimeter portion 139 and upper rib 136, has an inner diameter $D_1$. $D_2$ is greater than $D_1$, thereby causing a radial interference $I_1$ between the two surfaces.

Conventionally, interference between a "pail curl" such as flange 142 and the cover's skirt, if any, has been kept to a minimum or eliminated because excessive interference was known to cause so-called "dishing" of conventional container components. Such dishing can reduce the integrity of the engagement between the cover and the container.

Nevertheless it has been discovered that interference between the pail curl and cover's skirt that is preferably greater than about 0.2% measured on the diameter can be highly beneficial. In other words, the ratio between the outer diameter of the pail's flange to the inner diameter of the cover's skirt is preferably about 1.002:1 or greater. In fact, it has further been discovered that the interference is most preferably about 0.8% or even greater as measured on the diameters of the components. For example, for a large container (i.e., a 20 liter container or a container about 8 inches or more in diameter) with a pail curl having an outer diameter $D_2$ of about 300 mm, a radial interference $I_1$ of about 1.2 mm between the pail curl and the cover's skirt (i.e., a cover skirt having an inner diameter of about 297.6 mm) results in an interference of about 0.8% as measured on the diameter. It has been discovered that such increased interference improves the strength of the engagement between the components. Nevertheless, excess interference exceeding about 1.5% measured on the diameter may cause dishing of the container components under certain circumstances.

Also, it has been discovered that a similar degree of interference between the outer surface of lower flange 146 and the inner surface of outer skirt 122 is beneficial as well. Specifically, lower flange 146 has an outer diameter $D_4$ that is preferably greater than an inner diameter $D_3$ of the outer skirt 122 at a position above lower rib 138. A radial interference $I_2$ results from the difference between these diameters.

FIG. 6 is provided to illustrate the interference between the components with a cross-section of the cover superimposed over a cross-section of the container's wall. It should be understood that the inner surface of outer skirt 122 will stretch or deform to conform to the outer surfaces of upper flange 142 and lower flange 146 when the components are actually assembled and engaged.

Another preferred aspect of the invention will now be described with reference to FIG. 5. As shown, perimeter portion 139 is positioned in a plane that is substantially parallel to and at a height $H_1$ above body portion 120. Radially-extending surface 135 is positioned at a height $H_2$ above body portion 120. Although the planes of radially-extending surface 135 and perimeter portion 139 are not identical as shown in FIG. 5, it will be appreciated that they share substantially the same plane and that that plane is substantially parallel to and axially separated from the plane of body portion 120.

Body portion 120 has a substantially constant thickness $T_1$, axially-extending surface 137 has a thickness $T_2$, radially-extending surface 135 has a thickness $T_3$ and perimeter portion 139 has a thickness $T_4$. As for the outer skirt 122, its upper portion has a thickness $T_5$, tear line 126 has a thickness $T_6$, and a lower portion just above lower rib 138 has a thickness $T_7$. Although various relative dimensions can be selected, thickness $T_1$, is preferably about the same as thickness $T_2$ and thicknesses $T_1$ and $T_2$ are preferably less than thickness $T_3$. In one possible embodiment of this invention, thickness $T_3$ is preferably about 10% thicker or more as compared to thickness $T_1$ of body portion 120. For example, if $T_1$ is about 1.8 mm, then $T_3$ is preferably about 2.0 mm or more.

It has been discovered that improved engagement between the cover and the container's body can be accomplished by reducing the thickness $T_4$ of perimeter portion 139 as compared to the thickness $T_3$ of radially-extending surface 135 and/or the thickness $T_1$ of body portion 120. Such a reduction in thickness permits increased flexibility for deformation or stretching of the position of outer skirt 122 with respect to body portion 120 as the container's wall is inserted upwardly into radial space 134. In one possible embodiment, thickness $T_4$ is preferably about 70% or less of the thickness $T_1$ of body portion 120. For example, if $T_1$ is about 1.8 mm, then $T_4$ is preferably about 1.3 mm or less.

It has been discovered that the reduced thickness of the perimeter portion is especially beneficial when there is increased interference between the pail curl and the container's wall as was described with reference to FIG. 6. Such reduced thickness of the perimeter portion will permit deformation and/or stretching of the perimeter portion upon engagement with the container's wall so that perimeter portion 139 and skirt 122 can conform to the outer surface of flange 142. In the absence of such deformation, the likelihood of dishing is increased.

Thickness $T_6$ of tear line 126 is preferably significantly smaller as compared to thickness $T_5$ so that tear strip 124 can be easily removed by the end user of the container. Thickness $T_7$ of outer skirt 122 toward lower rib 138 is preferably greater than thickness $T_6$ but less than thickness $T_5$ for increased flexibility.

Referring particularly to FIG. 6, another preferred aspect of this invention will now be described. An intermediate detent or circumferential flange 145 extends outwardly from container wall 116 to a position that is adjacent to an inner surface of cover skirt 122. Although flange 145 is shown to be in contact with skirt 122 in FIG. 6, it will be appreciated that there can and perhaps should be some small space between the outer surface of flange 145 and the inner surface of skirt 122 when cover 118 is actually installed over wall 116. Flange 145 preferably extends radially outwardly and downwardly at a slight angle but can be formed in a variety of shapes. The purpose of intermediate flange 145 is to prevent excessive inward deflection of outer skirt 122 at a position between upper flange 142 and lower flange 146 of the container. Alternatively, intermediate flange 145 can be replaced by a detent or a rib positioned on an inner surface of skirt 122 and extending radially inwardly to a position adjacent to an outer surface of wall 116.

It has been discovered that, without intermediate flange 145, a significant space can result between an outer surface of wall 116 and an inner surface of skirt 122 at a location between upper and lower flanges 142 and 146. It has further been discovered that excessive inward deflection of skirt 122 (i.e., by side impact) at that location can tend to compromise the integrity of the engagement between the cover and the container wall. The provision of the preferred intermediate flange 145 at this location prevents such excessive deflection. This feature is especially beneficial when there is a significant axial distance between the upper and lower flanges on the container's wall.

Figure 7:
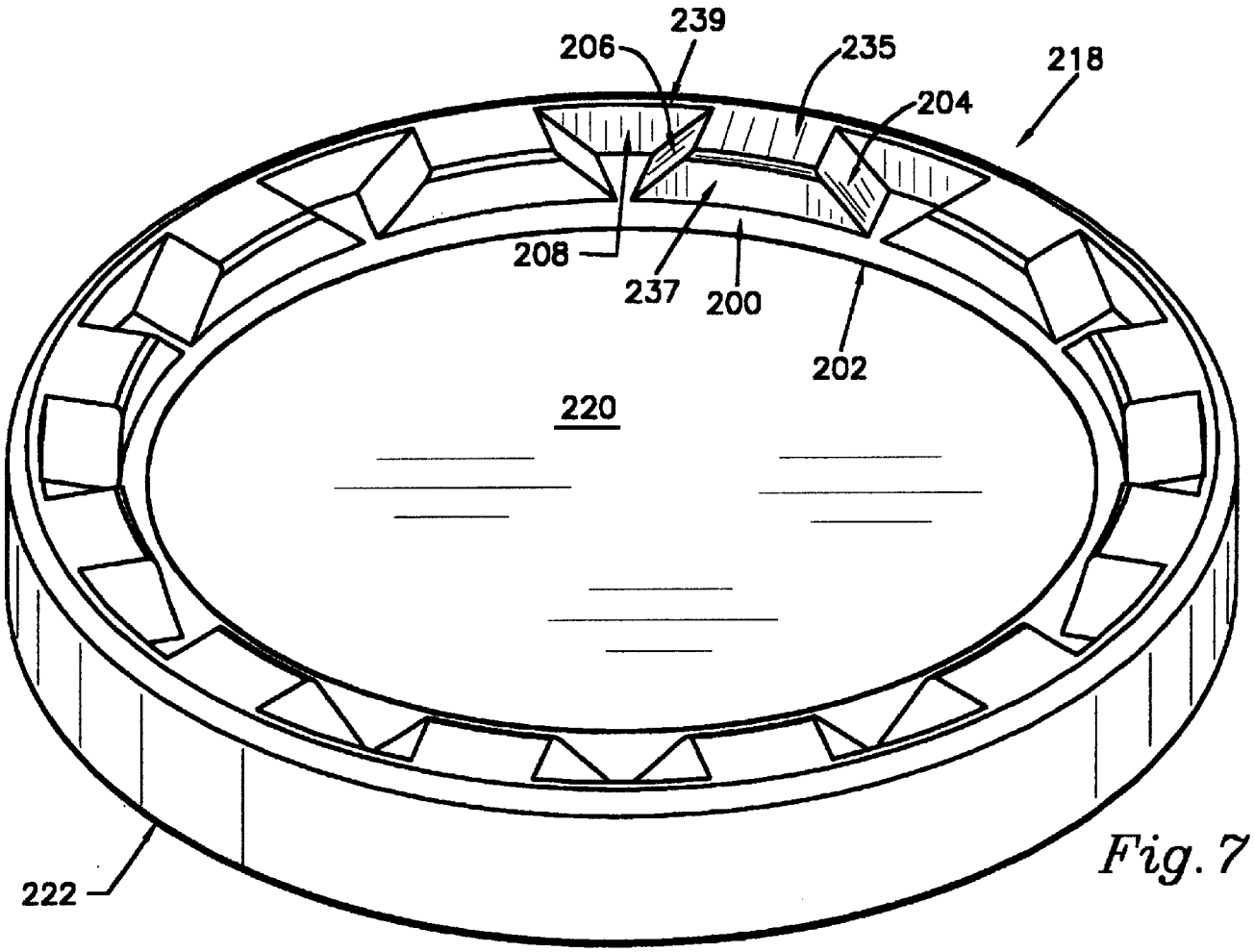
FIG. 7 is a perspective view of another embodiment of a cover according to this invention.

Yet another preferred aspect of the invention will now be described with reference to FIGS. 7 and 8. FIG. 7 illustrates an embodiment of a cover generally designated by the numeral "218". It has a body portion 220 with an outer skirt 222 extending about its circumference. It also includes a plurality of supporting surfaces such as supports 200 that are distributed about the perimeter of body portion 220 and separated by a plurality of spaces 202.

Supports such as supports 200 are preferred because they make it possible to eliminate ribs such as ribs 133 (FIGS. 5 and 6) that otherwise may be required to extend between the inner skirt 132 and body portion 120 of cover 118 to support the inner skirt with respect to the cover's body. In other words, supports 200 prevent excessive deflection of body portion 220 with respect to the inner skirt that could otherwise lead to the unintentional disengagement of the cover from the container or to the leakage of contents from within the container. Such deflection of body portion 220 can be caused by forces resulting from the storage and handling of the container assembly such as the force of material shifting within the container, an accumulation of pressure within the container that can tend to bow body portion 220 outwardly, the forces encountered by stacking filled containers one on top of the other which can tend to bow body portion 220 inwardly, forces encountered by contact between adjacent container assemblies, as well as many other forces known to be encountered during shipment, handling and storage.

Supports 200 include a radially-extending surface 235 that extends inwardly adjacent to perimeter portion 239 and then preferably curves downwardly into axially-extending surface 237, which terminates at body portion 220, thereby structurally connecting body portion 220 to perimeter portion 239. On either side of supports 200 are surfaces 204 and 206 that are preferably ramped downwardly at an angle but may also be vertical. Surfaces 204 and 206, together with a substantially vertical surface 208, define each of the spaces 202 between adjacent supports 200. Supports 200 are sometimes referred to as so-called "castellations".

Figure 8:
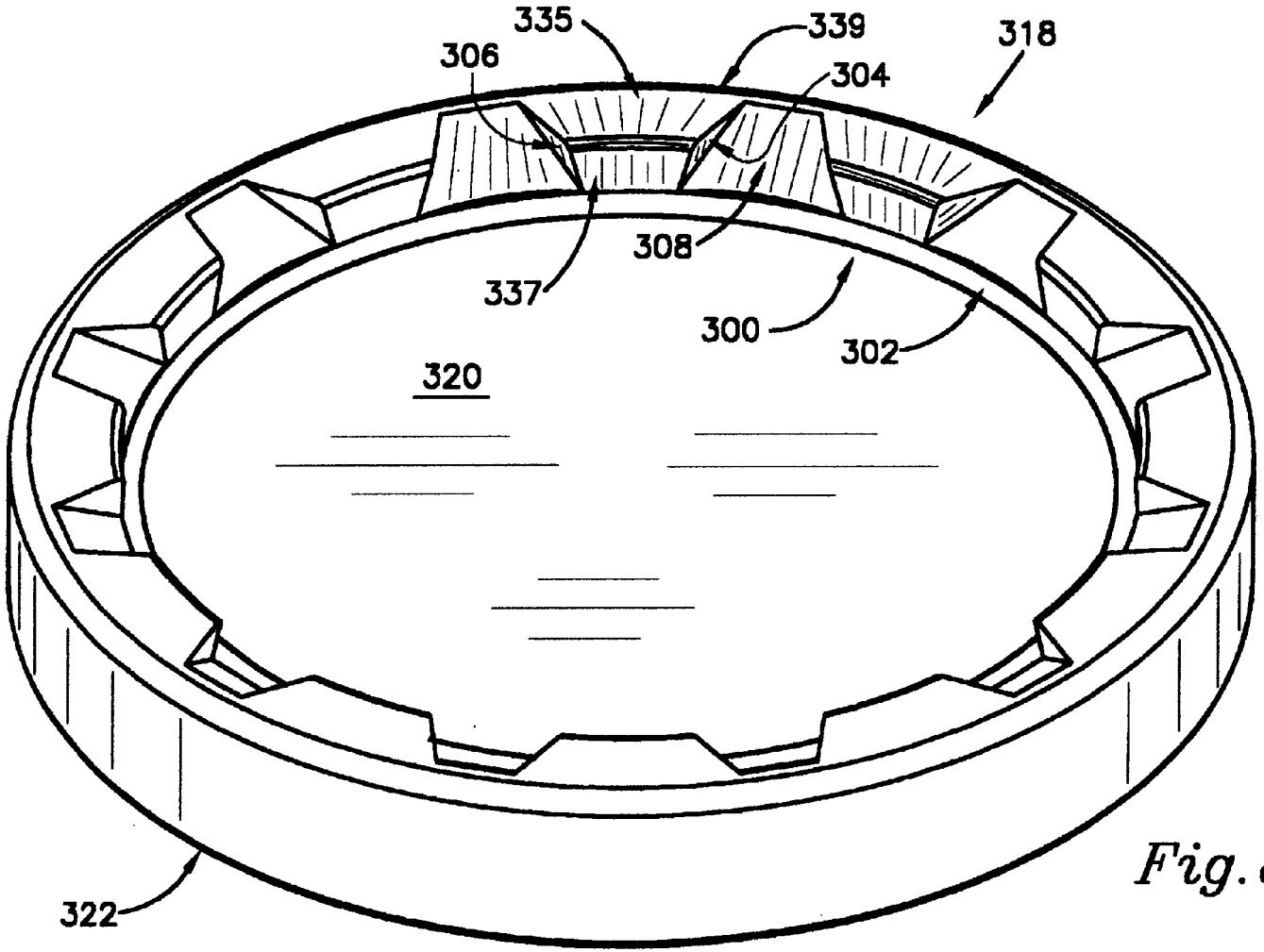
FIG. 8 is a perspective view of yet another embodiment of a cover according to this invention.

FIG. 8 illustrates another cover embodiment 318 that is similar to cover 218 except that the shape of the supports is slightly altered. Cover 318 has a body portion 320, a skirt 322, and a perimeter portion 339 that are substantially similar to those of cover 218. Cover 318 also has a plurality of supports 300, each having a radially-extending surface 335 that curves downwardly toward an axially-extending surface 337. Supports 300 are spaced about the perimeter of body portion 320 and they structurally connect perimeter portion 339 to body portion 320.

In between adjacent supports 300 are spaces 302 that are defined by surfaces 304 and 306 on the sides of supports 300 as well as circumferentially extending surfaces 308. Surfaces 308 in this embodiment are preferably ramped at an angle so that they extend downwardly and inwardly toward body portion 320. Surfaces 304 and 306 are preferably ramped downwardly and outwardly toward surfaces 208. Other configurations are contemplated as well so long as a support surface is defined adjacent to the perimeter portion and body portion of the cover.

Figure 9:
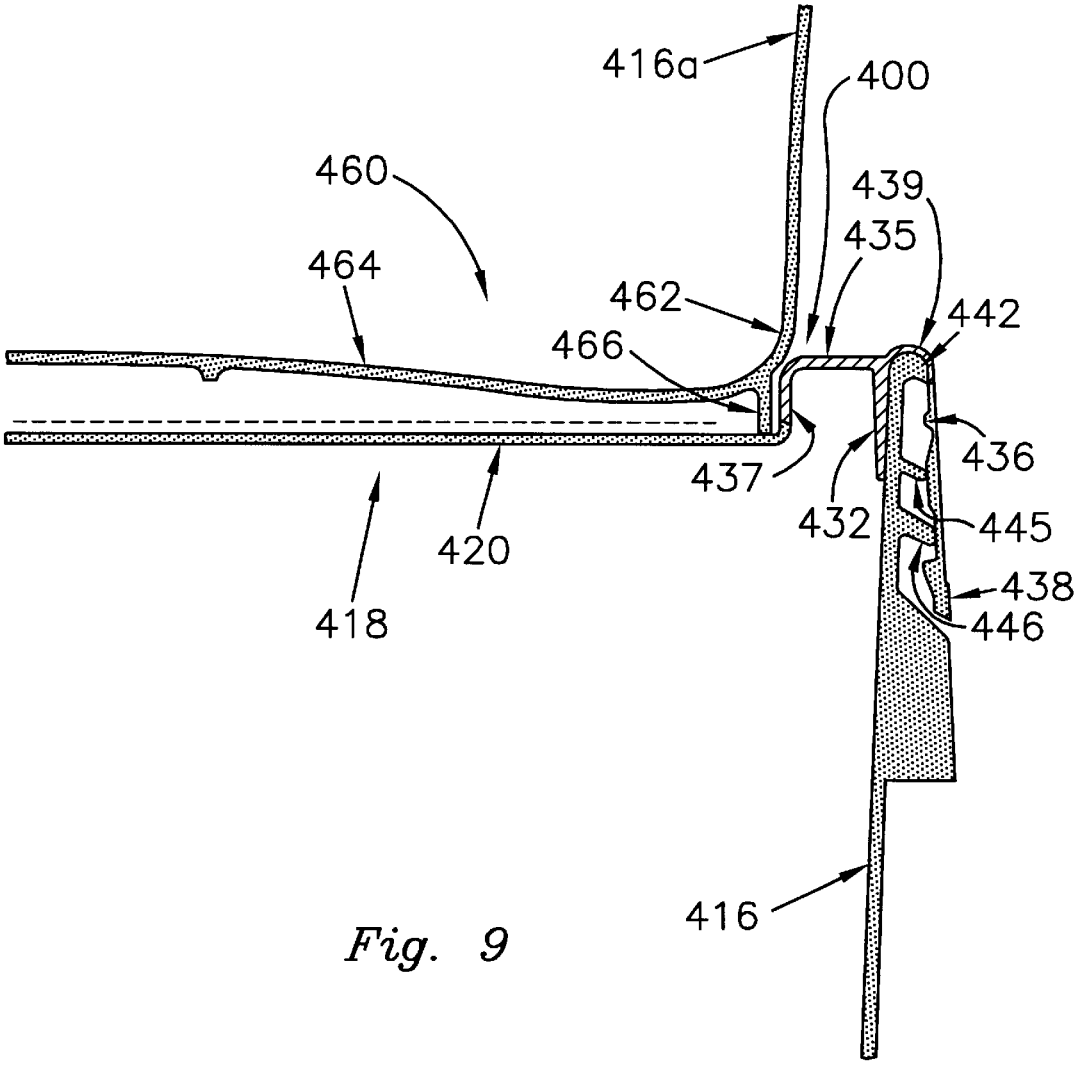
FIG. 9 is a cross-sectional side view of portions of two container assemblies according to this invention in a stacked relationship.
Figure 10:
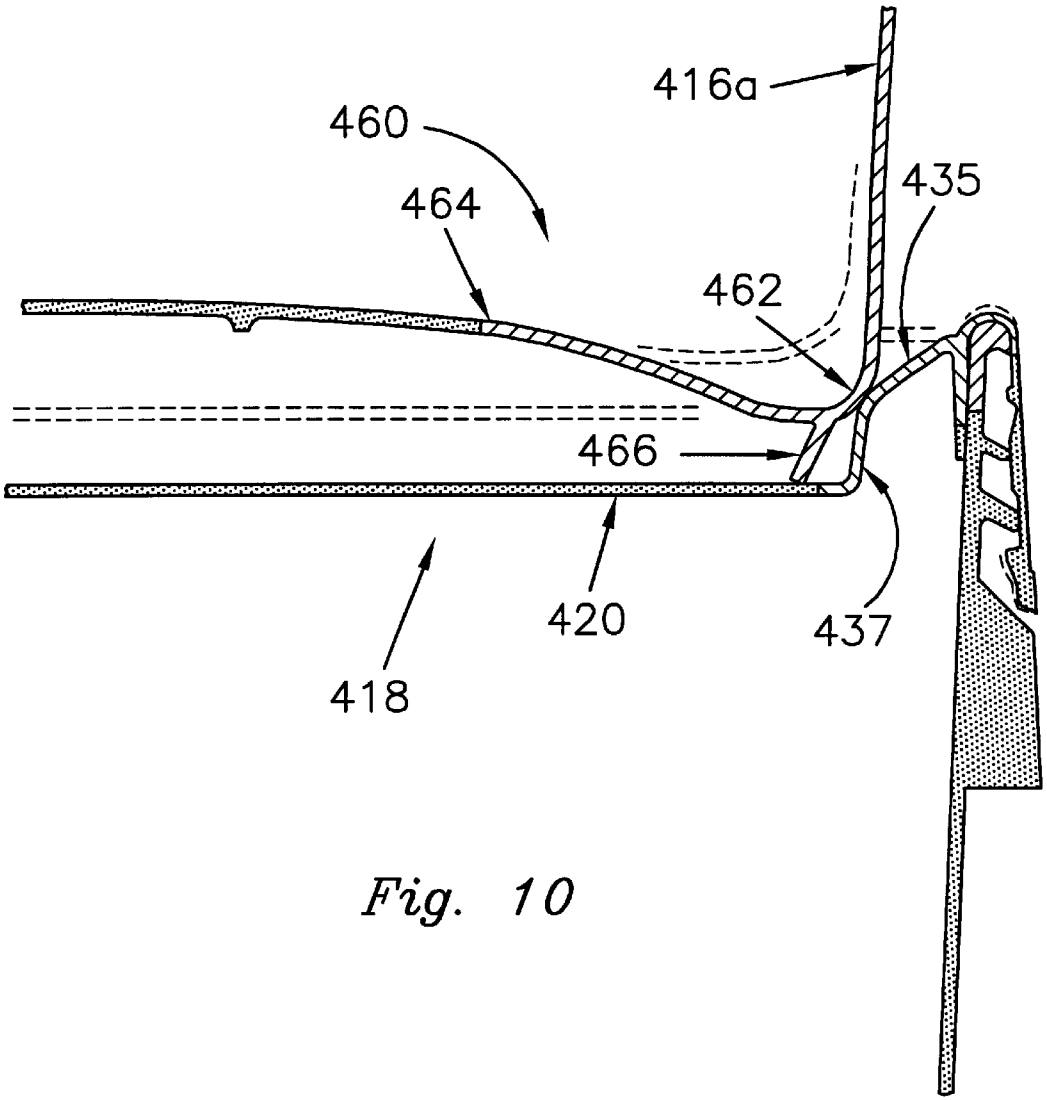
FIG. 10 is a cross-sectional side view of the container assemblies shown in FIG. 9, wherein the assembly components are shown under load.

Referring now to FIGS. 9 and 10, yet another preferred aspect of the invention will now be described. FIG. 9 illustrates portions of two container assemblies that are stacked one on top of the other. The underlying container assembly includes a container having a wall 416 and a cover 418 engaged thereon and having a cover body 420. Container wall 416 has many of the features of container wall 116, including an upper flange 442, an intermediate flange 445, and a lower flange 446. Cover 418 has features corresponding to cover 318, for example, including a perimeter portion 439 having a skirt with an upper rib 436 and a lower rib 438 as well as an inner skirt 432. A radially-extending surface 435 extends from perimeter portion 439 and an axially-extending surface 437 connects surface 435 to body portion 420. Surfaces 435 and 437 together define a support 400 that can be one of many circumferentially arranged supports separated by spaces like supports 200 and 300.

The container assembly stacked on top of the cover 418 includes a container wall **416*a*. It also includes a bottom portion 460 with a curved perimeter surface 462 that extends between wall 416*a* and a bottom surface 464. Also provided circumferentially adjacent to perimeter surface 462 is a bottom skirt 466 that acts as a support on which the container sits. As shown in FIG. 9, an outer surface of perimeter surface 462 is closely adjacent to the curved outer surface that extends between radially-extending surface 435 and axially-extending surface 437**.

The components shown in FIG. 9 are also shown in FIG. 10, but with a downward load applied to the components to simulate stacking. Such a load and the resulting deformation is a model of the forces that can be encountered when filled containers are stacked one on top of another in storage. As can be imagined, larger-sized containers that are filled with solid or liquid materials and stacked one on top of the other can generate a great deal of downward force on the lowermost container assemblies.

As shown in FIG. 10, outer perimeter surface 462 of the stacked container is now in intimate supporting contact with the surface extending between radially-extending surface 435 and axially-extending surface 437. It can also be noticed that the bottom surface 464 of the container's bottom portion 460 has bowed upwardly at its center and that the support member 466 has bent inwardly toward the center of cover 418. Also, the body portion 420 of cover 418 is pressed downwardly and radially extending surface 435 is cupped downwardly.

The simulated distortion and deflection shown in FIG. 10 is the result of a finite element analysis that was conducted to model the performance of the container assembly under extreme loads. The analysis indicates that significant engagement remains between the container's flanges (442 and 446) and the cover's ribs (436 and 438) despite the significant load applied to the assembly. In other words, the integrity of the engagement between the cover and the container's body as well as the integrity of the seal between the components can be maintained under significant stacking loads.

This is due at least in part to the manner with which the stacked container contacts the underlying cover and the interaction between perimeter surface 462, support member 466, body portion 420, surfaces 435 and 437, and inner skirt 432. As shown in FIG. 9, the diameter of support member 466 is preferably selected so that its outer surface is closely adjacent to surface 437. Also, the outer diameter of perimeter surface 462 is preferably selected so that its outer surface is closely adjacent to the curved surface between surfaces 435 and 437. The height $H_2$ (FIG. 5) of surface 435 and the height of support member 466 are also preferably selected so that perimeter surface 462 is closely adjacent to the surface between surfaces 435 and 437 when the assemblies are stacked. After a vertical stacking load is applied as shown in FIG. 10, support member 466 bends radially inwardly, surface 435 deflects downwardly, and perimeter surface 462 is urged against support 400, thereby distributing the stacking force among the spaced supports.

Many modifications are optionally made to the container assembly embodiment illustrated in the figures without departing from the spirit or scope of this invention. For example, modifications are optionally made to the container material, the container assembly size, and the shapes and configurations and dimensions of the various container components. Also, modifications are optionally made to the configuration of the cover locking mechanism so long as the primary objectives of this invention are achieved.

Although this invention is most advantageously incorporated into container assemblies used for Regulated Materials, it is of course contemplated for advantageous use for a wide variety of applications. In any use, the cover locking mechanism can be beneficial for material storage, material shipment and handling, tamper evidence, and so on. Important features of this invention are defined in the following claims.

What is claimed is:

1. A container assembly having a cover securely engageable to a container body:

said cover comprising a radially-extending surface, a circumferential inner skirt and a circumferential outer skirt extending downwardly from a perimeter portion of said radially-extending surface, said outer skirt having a rib extending radially inwardly from said outer skirt toward said inner skirt;

said container body having a wall having an upper edge portion fitting between said inner and outer skirts and a flange extending radially outwardly from said upper edge portion of said container body, said flange being positioned to be engageable with said rib on said outer skirt when said cover is applied to said container body between said skirts;

wherein said flange has an outer diameter that is larger than the inner diameter of said outer skirt on said cover to create and maintain an interference which is greater than about 0.8% and up to about 1.5%, wherein said cover is thinner than said radially-extending surface and is stretchably deformable to insert the container body wall between said inner skirt and said outer skirt of said cover.

2. The container assembly defined in claim 1, wherein said cover further includes an inner skirt extending downwardly adjacent to said perimeter portion and spaced radially inwardly from said outer skirt, said inner skirt and said outer skirt together defining an intervening space into which said wall upper portion of said container body is extendable.

3. The container assembly defined in claim 1, wherein said outer diameter of said flange is about 8 inches or more.

4. A locking mechanism for an assembly of a container cover and a container body, said cover comprising a body and an outer skirt extending downwardly about the circumference of said body, an inner skirt extending downwardly therefrom and spaced radially inwardly from said outer skirt, and a perimeter portion adjacent to the body of said cover and extending across between upper ends of said inner skirt and said outer skirt, and said container body comprising a wall having an upper portion defining an opening, said locking mechanism comprising:

a lock formed by engagement between (a) a rib formed on said outer skirt of said cover and extending radially inwardly from said outer skirt and (b) a flange formed on said upper portion of said wall of said container body and extending radially outwardly from said container, said engagement between said rib and said flange being made upon insertion of said upper portion of said wall of said container body into a radial space defined between said inner skirt and said outer skirt of said cover;

wherein at least a portion of said perimeter portion of said cover has a reduced thickness as compared to said body of said cover, and wherein said perimeter portion is sufficiently deformable for insertion of said upper portion of said container wall into said radial space, and for said engagement between said rib formed on said cover and said flange formed on said container body upon said insertion.

5. The locking mechanism defined in claim 4, wherein said reduced thickness portion of said perimeter portion has a thickness of about 70% or less of the thickness of said body of said cover.

6. The locking mechanism defined in claim 4, wherein said radial space defined between said inner skirt and said outer skirt in a relaxed condition is narrower than the radial thickness of said flange and wall on said container body.

7. The locking mechanism defined in claim 4, wherein said reduced thickness portion of said perimeter portion is adapted to stretch upon assembly of said cover and said container body.

8. A container assembly having a cover securely engageable to a container body:

said cover comprising a circumferential skirt extending downwardly therefrom, said skirt defining an upper rib extending radially inwardly from said skirt and a lower rib extending radially inwardly from said skirt and spaced from said upper rib;

said container body comprising a container wall having an upper portion defining an opening, an upper flange extending radially outwardly from said upper portion, and a lower flange axially spaced from said upper flange and extending radially outwardly from said upper portion;

wherein said lower rib on said cover is engageable with said lower flange on said container body and said upper rib on said cover is engageable with said upper flange on said container body;

said container body further comprising an intermediate detent extending radially outwardly from said upper portion of said wall at an axial location between said upper flange and said lower flange, and bearing physically upon the inner surface of said outer skirts of said cover wherein upon assembly of said cover and said container body said intermediate detent extends to a position proximal to and in contact with an inner surface of said outer skirt to resist radially inward deflection of said skirt and unintentional disengagement of said cover from said container body.

9. The container assembly defined in claim 8, wherein said intermediate detent is positioned for pressure contact with said inner surface of said outer skirt upon said deflection.

10. The container assembly defined in claim 8, wherein said intermediate detent extends downwardly at an angle from said upper portion of said container wall to the inner surface of said outer skirt of said cover.

11. A container assembly comprising a cover comprising a circumferential outer skirt extending downwardly from a perimeter portion thereof, said skirt having a rib extending radially inwardly from said outer skirt;

said container body having a wall having an upper portion defining an opening and a flange extending radially outwardly from said upper portion of said body, said flange being positioned to be engageable with said rib on said cover when said cover is applied to said container body;

wherein said flange has an outer diameter that is larger than an inner diameter of said outer skirt on said cover to create and maintain an interference which is greater than about 0.8% and up to about 1.5%;

wherein said cover further includes an inner skirt extending downwardly adjacent to said perimeter portion and spaced radially inwardly from said outer skirt, said inner skirt and said outer skirt together defining an intervening space into which said wall upper portion of said container body is extendable;

wherein at least a portion of said perimeter portion of said cover has a reduced thickness as compared to a body of said cover; and wherein said perimeter portion is sufficiently deformable for insertion of said container upper portion of said wall into said space defined between said intervening inner and outer skirts of said cover.

* * * * *